United States Patent [19]

Hung

[11] Patent Number: 4,785,592

[45] Date of Patent: Nov. 22, 1988

[54] METHOD FOR RAISING A MULTI-ELEMENT MAST AND APPARATUS FOR PERFORMING THE METHOD AND MASTS PROVIDED WITH THESE MEANS

[75] Inventor: Frederic N. B. Hung, St Amand les Eaux, France

[73] Assignee: Laboratoire d'Etudes et de Recherches Chimiques (LERC) S.A., St. Amand les Eaux, France

[21] Appl. No.: 41,449

[22] Filed: Apr. 23, 1987

[30] Foreign Application Priority Data

Apr. 24, 1986 [FR] France ..... 86 06409

[51] Int. Cl.[4] ..... E04H 12/18; E04H 12/34

[52] U.S. Cl. ..... 52/118; 52/745

[58] Field of Search ..... 52/745, 123.1, 125.1, 52/111, 118, 297

[56] References Cited

U.S. PATENT DOCUMENTS

| | | | |
|---|---|---|---|
| 1,095,197 | 5/1914 | Entenmann | 52/297 |
| 3,185,265 | 5/1965 | White | 52/111 |
| 3,273,859 | 9/1966 | Walli | 52/745 |

FOREIGN PATENT DOCUMENTS

| | | | |
|---|---|---|---|
| 26475 | of 1914 | United Kingdom | 52/123.1 |

*Primary Examiner*—James L. Ridgill, Jr.
*Attorney, Agent, or Firm*—Kerkam, Stowell, Kondracki & Clarke

[57] ABSTRACT

The invention relates to multi-element masts and a method of raising a multi-element mast by adding successive elements wherein a direction of traction (15) to be exerted by at least one operator on the free portion (16) of a tieline (8) emerging from a support plate (7) that enables raising the mast elements by the ascending movement of the plate (7) is defined and on a locking device (18) is fixed with respect to a mast guide shaft (4) and allows the portion of the tieline (8) emerging from the support plate (7) to unwind when the support plate is engaged and the tieline is pulled in the defined direction of traction (15). The locking device also permits locking of the tieline (8) against translation in the direction opposite the direction of traction previously defined, substantially at the end of any traction action. A traction device (20) is provided which includes at least one handle element (21) enabling it to be grasped by at least one operator and at least one locking device (22), which, symmetrically to the locking device fixed to the mast guide shaft (4), first, enables locking the traction device (20) via the bias of the locking means against translation on the tieline when the operator(s) urges the tieline in the predefined traction direction (15), and, second, enables free sliding of the traction device on the tieline (8) when the operator(s) suitably holding the free end (11) of the tieline (8) tends to displace the traction device on the tieline (8) in the opposite direction from the defined traction direction (15).

16 Claims, 1 Drawing Sheet

METHOD FOR RAISING A MULTI-ELEMENT MAST AND APPARATUS FOR PERFORMING THE METHOD AND MASTS PROVIDED WITH THESE MEANS

RELATED APPLICATIONS

This application is related to the following U.S. applications:

1. "Cylindrical Mast Element for End to End Assembly with Other Elements so as to Constitute a Mast", Guy Guislain and Yves Foissac, U.S. Ser. No. 745,934, corresponding to French application 84.09.998.

2. "Device for Wind Bracing the Members of a Lattice Mast and Lattice Mast Provided with Said Devices", U.S. Ser. No. 745,940, corresponding to French application 84.09.999.

The subject matter of each of said related applications is hereby incorporated by reference.

FIELD OF THE INVENTION

The invention relates to a method for raising a multi-element mast by adding successive elemens to its base, and to the apparatus for performing the method and masts provided with these means. More particularly, but not exclusively, it relates to methods for raising elements of masts intended to support and orient temporary transmitting and/or receiving antennas used for both military and civilian purposes at a great height above the ground, for instance 30 to 35 meters.

BACKGROUND OF THE INVENTION

Because of the temporary nature of the installation of such antennas, to facilitate moving them it is known to assemble these masts from a plurality of generally cylindrical elements which, when they are installed, are joined end to end. At each of their end to end junctions, the elements are assembled by the engagement of one of the elements with a sleeve carried by the other element.

For a mast of this kind, the topmost elements supporting the antenna are first assembled. Then this group of elements is made to engage a vertical shaft which is supported on the ground via a base or supporting framework. To raise the antenna to the desired height, supplementary elements are passed upward through the bottom of this shaft to engage the lowermost element of the group and are themselves engaged in succession one to the other. The top of the mast is thereby raised progressively.

Naturally, to disassemble the mast this procedure is reversed.

The mast may be of a single pole type comprising a plurality of stacked elements or a lattice mast of the type described in aforenoted application Ser. No. 745,940.

The top of the mast is generally raised by the height of one element at a time. To effect this progressive elevation, a raising device is used that principally comprises a support plate which supports the element to be added to the group of elements supporting the antenna, the support plate is connected via a tieline to at least one raising device that enables the plate to be raised toward the bottom of the shaft, i.e. in the upward direction.

Typically, these raising devices comprise winches that are actuated by the operator or operators assembling the mast. A winch raising device typically includes a mechanism having a drum for winding up the tieline. The drum is driven in rotation by a device that reduces the effort to be exerted on the tieline. Naturally the mechanism also includes a suitable ratchet device by which untimely unwinding of the tieline on the drum can be prevented, due to the influence of the load being raised.

prior art raising mechanisms designed in this way give good results, especially in the case where heavy loads are raised. Nevertheless, they have the disadvantage of being bulky and relatively costly, taking into account their complexity and may require the availability of electrical power which is not readily available at remote field installations.

OBJECT AND SUMMARY OF THE INVENTION

One object the invention is to provide is a method for raising masts that uses simple and inexpensive means, while enabling assurance that masts will be erected under conditions that are highly safe for the operating personnel.

To this end, the subject of the invention is a method for raising a multi-element mast which comprises:

defining the direction of traction exerted by at least one operator on the portion of a tieline emerging from a support plate to enable raising mast elements by the ascending movement of the support plate;

passing the tie line through a locking device fixed with respect to a guide shaft, which locking device on the one hand allows the portion of the tieline emerging from the support plate to unwind in the defined direction when the support plate is engaged and the support plate to be urged upward when a force is exerted in the defined direction of traction, and on the other hand permits locking this portion of the tieline against translation in the direction opposite the direction of traction previously defined, substantially at the end of any traction action;

grasping the free end of the tieline with the aid of a traction device, which includes at least one element enabling it to be grasped by at least one operator and at least one means, which, symmetrically to the locking device fixed with respect to the guide shaft, first, enables locking the traction device against translation with respect to the tieline, when via the bias of the device at least one operator urges the tieline in the predefined traction direction, and, second, enables free sliding of said traction device on the tieline when at least one operator suitably holding the free end of the tieline tends to displace the traction device on the tieline in the opposite direction from the defined traction direction.

The invention also relates to the means for raising the multi-element mast comprising, in combination:

a locking device, fixed with respect to a guide shaft, which device allows unwinding of a tieline when the tieline is urged by at least one operator in a selected direction of traction and permits locking the tieline against translation in the direction opposite to a direction of traction, such as that defined previously, substantially at the end of any traction operation, and a traction device, engaging the same tieline, which traction device includes at least one element enabling it to be grasped by at least one operator performing the raising operation and at least one means, which, symmetrically to the locking device fixed with respect to the shaft, first, enables locking the traction device against translation on the tieline, when via the bias of this device at least one operator urges the tieline in the predefined direction of traction, and, second, enables free sliding of the traction device on the tieline when the operator or operators suitably holding the free end of the tieline tend to displace the traction device on the tieline in the direction opposite from the defined direction of traction.

In an alternate embodiment, these means also include a device for reducing the tractile effort of the raising operation, which device comprises a multiplicity of pulleys, about which the tieline is passed and which are arranged between the bottom of the guide shaft and above the support plate to form an effort-reducing tackle.

The invention also contemplates the combination of the multi-element mast for supporting an antenna and its raising device.

The invention will be better understood from the ensuing detailed description of an exemplary embodiment, taken in conjunction with the drawings.

DESCRIPTION OF THE PREFERRED EMBODIMENT

Figure 1:
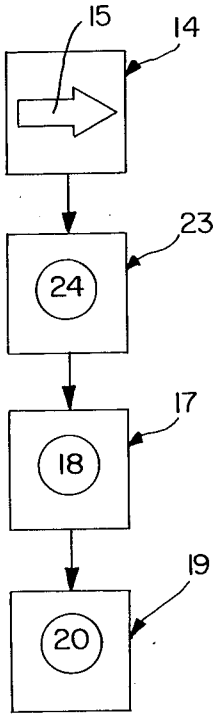
FIG. 1 is a block diagram illustrating the method.

FIG. 1 illustrates by way of a flow diagram the main steps of the method identified as steps 14, 23, 17 and 29 to be hereinafter described in greater detail.

Figure 2:
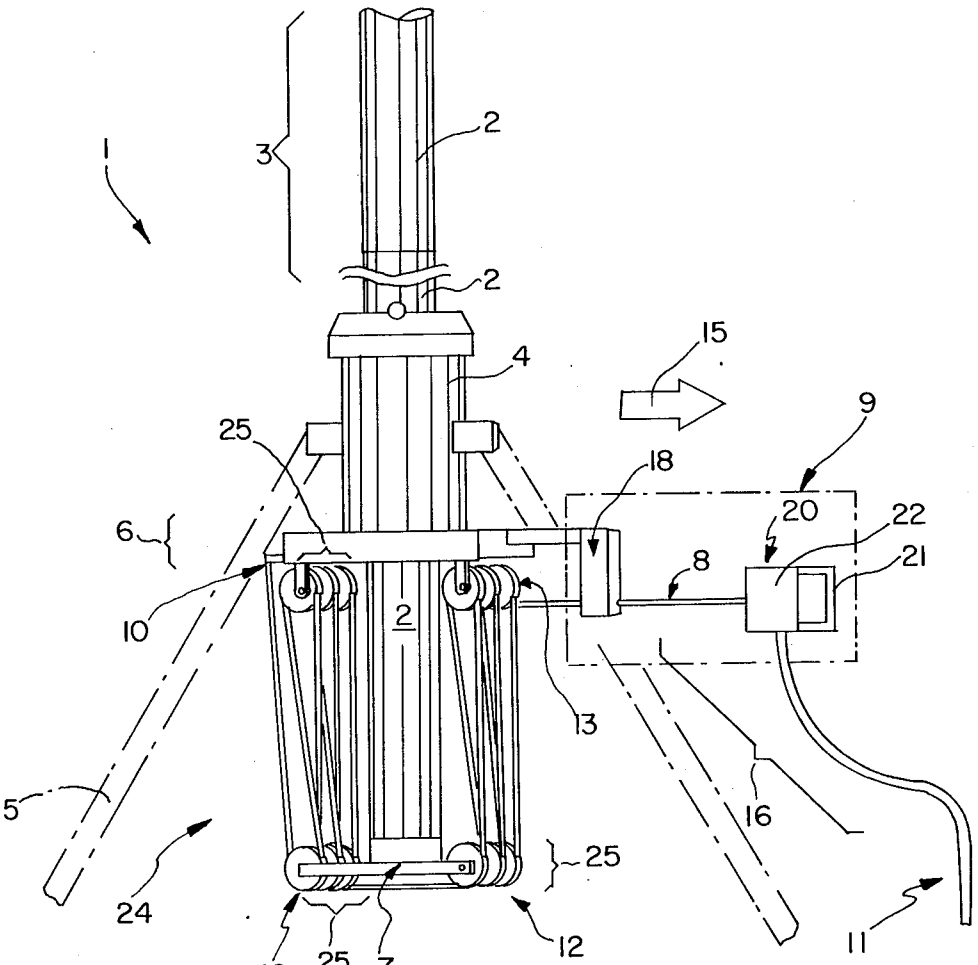
FIG. 2 shows an embodiment for performing the method according to the invention.

Referring first to FIG. 2, the drawing shows a mast raising apparatus 1 for raising of a mast 3 comprising several elements 2 assembled end to end, in a standard manner, and connected at the lower end to a vertical shaft 4 supported on the ground via a base support framework 5, the framework being shown by phantom lines. To construct the mast 3, the first step, as usual, is to assemble several elements 2 of the top of the mast, the uppermost of which may include an antenna. This group of elements is then made to engage the vertical supporting guide shaft 4. Guide shaft 4 is of standard construction having a central passage and means to facilitate passage of a mast element therethrough and locking the assembled elements in a vertical position. Guide shaft 4 does not form an inventive feature of the present invention and is known in the art. Accordingly, the details of the structure are not described herein.

Next, to raise the top elements to the desired height, an additional element is connected to the lowermost of the assembled elements by passing the additional element through bottom base support 6 of the shaft 4 until the upper end of the additional element is brought into contact with the lower end of the lowermost elements of the mast assembly. The supplementary elements required are thus brought into engagement in succession, thereby raising the top of the mast to the desired height. The junctions of the elements are joined in a well known manner by a sleeve (not shown) carried by one of the elements, however, any one of several known techniques for joining abutting cylindrical or tubular elements may be utilized.

The top of the mast is raised by the height of one element 2 engaging the shaft 4 at a time, by a raising device 24 (step 23) (means for raising) which includes a support plate 7, connected by a tieline 8 to at least one take-up device 9 that enables traction on the tieline 8 to be exerted by which the plate 7 is taken up or raised toward the base support 6 of the guide shaft 4. Support plate 7 may advantageously be provided with a vertical cylindrical riser having a reduced diameter which fits into the hollow cylindrical end of the lowermost element 2.

As shown in FIG. 2, one end 10 of the tieline 8 is anchored in the usual manner to the ase support 6 of the guide shaft 4. This tieline 8 passes through return pulleys 12, 13 supported at opposite ends of the base support 6 of the guide passing first around a lower pulley 12 and then around an upper pulley 13. Pulley 13 is anchored at the bottom of the shaft base support 6 by a suitable support and in turn allows the tieline to be directed toward the takeup device 9 in a preselected direction of traction (step 14).

Instead of resorting to use of a winch for exerting the raising traction on the tieline as is done in the prior art, in accordance with the present invention, a traction or pull is exerted on the free portion 16 of the tieline 8 in the traction direction 15 by one and/or more operators. This enables the assembled mast elements to be raised by the ascending movement of the support plate. Means for raising the assembled mast elements take the form of a take up device or means (9) including a locking device 18 fixed with respect to the guide shaft 4. Device 18 is advantageously fixedly supported to a bar member extending from the base support means 6. Locking device 18 allows on the one hand the portion of the tieline 8 emerging from the support plate 7 to unwind when the tieline 8 is pulled and urged in the defined direction of traction 15, and on the other hand permits locking (step 17) the tieline 8 against translation in the direction opposite the direction of traction substantially at the end of any traction action so as to fix the mast elements in a raised position dependent on the extent of traction force applied. To this end, to raise the assembled elements, the free end of the tieline is grasped with the aid of a traction device 20. Device 20 includes at least one handle element 21 enabling it to be grasped by at least one operator and at least one locking means 22, which, symmetrically to the locking device fixed to the shaft, first, enables locking (step 19) the traction device 20 against translation with respect to the tieline via the bias of this device when the operator or operators urge the tieline in the predefined traction direction 15, and, second, enables free sliding of the traction device on the tieline 8 when the operator or operators suitably holding the free end 11 of the tieline 8 tend to displace the traction device on the tieline 8 in the opposite direction from the defined traction direction 15. By repeating pulling efforts in which the locking means is first locked to the tieline, the tieline pulled in direction 15, releasing the locking means and sliding or displacing the traction device 20 back along the tieline toward pulley 13 in a direction opposite to the defined traction direction, again locking means 20 to the tie line, and repeating the foregoing steps, the lowermost mast element 2 and consequently all assembled elements supported thereto are raised incrementally. The mast can thus be raised manually a very high distance with very little operating space around the supporting framework, i.e. in very confining environments such as, for example, shipboard. If sufficient room is available, the traction force can of course be continuous by exerting a continuous pull until the desired elevation of support plate 7 is reached.

In a preferred embodiment for performing the method according to the invention, means 24 (step 23) are provided (prior to step 17) for enabling the tractile effort required to be exerted by the operator or operators to raise the mast elements to be reduced. This means comprises a multiplicity 25 of lower pulleys 12 and upper pulleys 13, about which the tieline 8 is passed and which are arranged between the bottom of the shaft 4 and its support plate 6 and the support plate 7 to form an effort-reducing tackle having a mechanical advantage.

To raise the support plate 7 toward the bottom 6 of the shaft, which is fixed relative to the ground or its supporting platform, it is sufficient for the operator, preferably after having taken care to engage the tieline in the locking device 18, to grasp the handle 21 of traction device 20 with one hand and the free portion 16 of the tieline with the other and to exert a tractile force or movement on the tieline with the aid of the traction device, i.e. by pulling in the direction of arrow 15. Then, at the end of this movement, the traction device 20 is displaced on the tieline 8 opposite to the direction of pull 15 while holding the free end 11 of the tieline 8 and thereafter once again exert traction; and so forth, until the plate 7 and mast 3 is in the position desired.

When the mast is disassembled, the operator must monitor the lowering of the mast elements. To this end, he monitors the unwinding of the tieline 8 by engaging it with and/or disengaging it from the locking device 18.

The means for performing the method include, in combination locking means 18 fixed with respect to the guide shaft 4 which allows unwinding of the tieline 8 when it is urged by the operator or operators in the defined traction direction 15 and locking of the tieline 8 against translation in the direction opposite the above-defined traction direction, substantially at the end of any tractile raising action and a traction means 20 for raising the multi-element mast which includes at least one element 21 enabling it to be grasped by the operator or operators performing the raising operation and at least one locking means 22, which, symmetrically to the locking device of the shaft, first, enables via the application of a bias force to the tie line locking the traction device 20 against translation on the tieline 8, when the operator or operators urge the tieline 8 in the predefined traction direction 15, and, second, enables free sliding of the traction device on the tieline 8 when the operator or operators suitably holding the free end 11 of the tieline 8 tend to displace this traction device on the tieline 8 in the opposite direction from the defined traction direction 15.

In an alternate embodiment, raising means 24 are provided which also include a device for reducing the tractile effort of the raising operation. The raising means 24 comprises a multiplicity of lower pulleys 12 and upper pulleys 13, about which the tieline 8 is passed. The pulleys 13 are disposed at the level of the base support 6 of the shaft and pulley 12 are disposed at the level of the support plate 7 to form an effort-reducing mechanical advantage tackle. Pulleys 12 are fixed in position while pulleys 13 are supported from movable plate 7 and rise and fall with movement of this plate.

As for the effort-reducing pulley raising means 24, the number of pulleys that comprise the tackle is a function of the desired reduction in the tractile effort and can be readily calculated knowing the weight to be raised.

The invention may be realized by use of a wedge-type catch of the type used in sailing navigation for the locking device 18, and use of a self-locking handle of the type used in mountain or rock climbing by those practicing that sport as the traction device 20. These elements should of course be arranged in such a manner that they work symmetrically.

Preferably, the tieline used in this case is of the type rope used in climbing.

One skilled in the art can certainly determine the most appropriate means to comprise each of these devices.

What is claimed is:

1. A multi-element mast comprising:

a plurality of mast elements joined in an end-to-end manner, said mast being vertically arranged and adapted to support an antenna at an upper portion thereof;

a vertical guide shaft having an opening extending therethrough, said guide shaft housing a lower portion of said mast and having means for securing said lower portion of said mast to prevent vertical downward movement of said mast;

framework ground supporting means for supporting said mast and said guide shaft at a predetermined distance from a ground surface; said supporting means being connected to said guide shaft;

means for progressively raising successive mast elements through said guide shaft, said raising means including a support plate adapted to receive a bottom of a lower mast element of said mast, said support plate adapted to be raised and lowered in a vertical manner, a tieline, said tieline having a first and a second end, said first end being affixed to said guide shaft, said second being a free end, a plurality of pulleys, at least one pulley being attached to said guide shaft and at least one other pulley being supported from said support plate, wherein said free end of said tieline is arranged to pass over said pulleys and wherein said tieline may be used to move said support plate vertically between a position near said ground surface and a position near said guide shaft;

takeup means for engaging said tieline intermediate said first end and said second end, said takeup means further comprising:

a traction device including handle means (21) for engaging said tieline to assist at least one operator in exerting a traction force on a free portion of said tieline in a predetermined direction of traction, wherein translation of said tieline in said predetermined direction will cause said tieline to unwind from said pulleys and to cause said support plate to be raised vertically toward said guide shaft;

said tration device further including traction means for gripping said tieline to prevent relative movement between said handle means and said tieline when said traction force is applied in said predetermined direction of traction, said traction means further permitting said handle means to slide freely on said tieline in a direction opposite said predetermined direction when a force is applied by an operator tending to displace said handle means in the direction opposite the predetermined direction; and locking means (18) for selectively locking said tieline to prohibit translation, said locking means disposed to engage said tieline at a position intermediate of said pulleys and said handle means, said locking means being fixed with respect to said guide shaft, said locking means on the one hand allowing said tieline to unwind from said pulleys when said traction force is applied in said predetermined direction, said locking means on the other hand, when said traction force is substantially ceased, being operable to lock said tieline to prohibit translation of said tieline in the direction opposite said predetermined direction.

2. A mast according to claim 1, wherein the locking means (18) comprises a wedge-type catch.

3. A mast according to claim 2 wherein the traction device (20) comprises a self-locking handle.

4. A mast according to claim 1, wherein said means for raising the mast elements includes at the level of the guide shaft (4) and of the support plate (7), means (24) for reduction of a tractile effort to be exerted.

5. A mast according to claim 4, wherein said means (24) for reduction of the tractile effort comprises a multiplicity (25) of pulleys (12, 13) about which the tieline (8) is passed and which, arranged at the level of the bottom of the shaft (4) and of the support plate (7), form an effort-reducing tackle.

6. A mast according to claim 5 wherein said means (24) for reduction of the tractile effort comprises a multiplicity (25) of pulleys (12, 13) about which the tieline(8) is passed and which, arranged at the level of the bottom of the shaft (4) and of the support plate (7), form an effort-reducing tackle.

7. A mast according to claim 6 wherein the traction device (20) comprises a self-locking handle.

8. A mast according to claim 4, wherein the locking means (18) comprises a wedge type catch.

9. A mast according to claim 8 wherein the traction device (20) comprises a self-locking handle.

10. A method for raising a multi-element mast wherein successive elements are added to a bottom of said mast, comprising the steps of:

(a) assembling a first and a second upper element, said first upper element having an antenna attached thereto;

(b) mounting said first and second upper elements within a vertical guide shaft, said guide shaft having a bore therethrough, said guide shaft being spaced at a predetermined distance from a ground surface and supported by a base framework;

(c) securing said second upper element within said vertical shaft to prevent said first and second elements from moving vertically downwardly;

(d) disposing, in said space between said guide shaft and said ground surface, a support plate and a tieline, said support plate being operable, by means comprising said tieline, to move vertically between a position near the ground surface and a bottom of said guide shaft;

(e) defining a direction of traction wherein movement of said tieline in said direction will cause said support plate to be raised toward said guide shaft, and movement opposite said direction will cause said support plate to be lowered;

(f) lowering said support plate to a lowered position near the ground surface;

(g) engaging said tieline to at least one takeup device, said takeup device including locking means for permitting movement of said tieline in said direction of traction upon application of a traction force, said means being further operable to prevent movement of said tieline in said direction opposite the direction of traction substantially upon release of said traction force;

(h) placing a first additional mast element in a vertical orientation on said support plate, when said support plate is in a lowered position with respect to said vertical shaft;

(i) grasping said tieline with a traction assist device at a free end thereof extending from said locking means;

(j) locking, by application of a traction force, said traction assist device onto said tieline to prevent relative movement between said traction assist device and said tieline when said tieline is moved in the direction of traction;

(k) applying a force on said tieline in the direction of traction sufficient to move said tieline in said direction, thereby causing said support plate carrying said first additional mast element to be raised toward and into an opening in said bottom of said guide shaft; and causing said first additional element to engage a lower end of said second upper element;

(1) ceasing the application of force on the tieline;

(m) unlocking said traction assist device from said tieline;

(n) sliding said traction device along said tieline in a direction opposite the direction of traction; and (o) repeating steps (j)-(n) above, as necessary to raise said support plate carrying said first additional mast element substantially to the level of the bottom of said guide shaft.

11. The method of claim 10 comprising, prior to engaging said tieline to said takeup device, the step of:

passing said tieline through a plurality of pulleys arranged at the level of said bottom of said vertical shaft and on said support plate, thereby forming an effort-reducing tackle.

12. The method of claim 10 comprising the further steps of:

(p) securing said first additional mast element within said guide shaft to prevent said element from moving vertically downward when said support plate is removed;

(q) lowering said support plate to its original lowered position;

(r) placing a second additional mast element in a vertical orientation on said support plate;

(s) repeating steps (i)-(o) of claim 10 as necessary to raise said support plate carrying said second additional mast element substantially to the level of the bottom of said vertical shaft.

13. The method of claim 12 comprising the further step of:

(t) repeating steps (p)-(s) recited above with a plurality of successive mast elements.

14. A device for raising a lightweight multi-element mast by adding successive elements to a bottom of said mast, comprising:

a vertical guide shaft having a bore therethrough, said vertical guide shaft being spaced apart from a ground surface at a predetermined distance;

a base framework connected to said guide shaft, said base framework supporting said guide shaft at said predetermined distance from said ground surface, wherein said successive mast elements are introduced through a bottom opening in said shaft and raised into engagement with a lowermost mast element to thereby progressively raise the top of the mast;

raising means for raising said mast elements and said mast, said means comprising:

a support plate adapted to receive a bottom portion of each of said successive elements, at least a first pulley connected to said support plate;

at least a second pulley supported from said guide shaft;

a tieline having a first end and a second end, said first end being affixed to said guide shaft, said second end being a free end, said tieline further being wound about and engaging said first and said second pulleys;

takeup means, intermediate said second free end of said tieline and a portion of said tieline emerging from said pulleys, for enabling said mast elements to be raised in response to an application of a traction force in a predetermined direction of traction, such that when said force is exerted by at least one opeator at said free end of said tieline, a translation of said tieline in said predetermined direction causes said pulleys to raise said support plate vertically upward toward said guide shaft, said takeup means incuding:

locking means for locking said tieline, said locking means fixed in position with respect to said guide shaft, said locking means so constructed and arranged to allow, on the one hand, a translation of said free end of said tieline when said traction force is applied in said predetermined direction of traction and, on the other hand, to lock said free end of said tieline thereby prohibiting translation of said tieline in a direction opposite said predetermined direction of traction when said traction force is substantially ceased, means for grasping said free end of said tieline including at least one handle means adapted to be grasped by at least one operator, and at least one means for locking said grasping means to said tieline when said traction force is applied in said predetermined direction of traction, and for allowing said grasping means to freely slide along said tieline in the direction opposite the predetermined direction of traction.

15. A device according to claim 14 further including at the level of the guide shaft (4) and of the support plate (7), means (24) for reduction of a tractile effort to be exerted by at least one operator.

16. A device according to claim 15 wherein said means for reduction comprises a multiplicity (25) of pulleys (12, 13) about which the tieline (8) is passed and which, pulleys include a first set (12) supported at the level of the bottom of the shaft (4) and a second set (13) supported at the level of the support plate (7) to form an effort-reducing tackle.

* * * * *